US006728984B2

(12) United States Patent
Dietrich

(10) Patent No.: US 6,728,984 B2
(45) Date of Patent: May 4, 2004

(54) BED, IN PARTICULAR SICKBED OR NURSING BED

(75) Inventor: Michael Dietrich, Leubsdorf (DE)

(73) Assignee: Voelker AG, Witten (DE)

( * ) Notice: Subject to any disclaimer, the term of this patent is extended or adjusted under 35 U.S.C. 154(b) by 0 days.

(21) Appl. No.: 10/253,578

(22) Filed: Sep. 25, 2002

(65) Prior Publication Data

US 2003/0131413 A1 Jul. 17, 2003

(30) Foreign Application Priority Data

Sep. 25, 2001 (DE) ..... 101 47 142

(51) Int. Cl.[7] ..... A61G 7/06
(52) U.S. Cl. ..... 5/620; 5/600
(58) Field of Search ..... 16/35 R, 18, 30; 5/620, 600, 602, 627

(56) References Cited

U.S. PATENT DOCUMENTS 5,377,372 A * 1/1995 Rudolf et al. ..... 5/600
5,457,849 A * 10/1995 Branson et al. ..... 16/19
5,737,801 A 4/1998 Flood
5,903,940 A 5/1999 Volker et al.

FOREIGN PATENT DOCUMENTS

DE 43 19 516 C2 12/1994

* cited by examiner

*Primary Examiner*—Teri Pham Luu
*Assistant Examiner*—Fredrick Conley
(74) *Attorney, Agent, or Firm*—Birch, Stewart, Kolasch & Birch, LLP

(57) ABSTRACT

The bed, in particular a sickbed or nursing bed, includes a bedstead having a mattress supporting surface and a plurality of swivelling rollers each of which is provided with a holding element attached to the bedstead and at least one roller body rotatably supported on the holding element. The bedstead includes receiving portions for the holding elements. Each receiving portion has an open lower side averting the mattress supporting surface of the bedstead, beyond which lower side the respective holding element projects. Each receiving portion is further open at at least one side face essentially extending transversely to the lower side. The holding elements are capable of being inserted via these side faces into the receiving portions.

7 Claims, 4 Drawing Sheets

BED, IN PARTICULAR SICKBED OR NURSING BED

BACKGROUND OF THE INVENTION

The present invention relates to a bed, in particular a sickbed or a nursing bed.

Sickbeds and nursing beds are normally mobile beds and for this purpose comprise swivelling rollers mounted on the bedstead, which swivelling rollers are in most cases configured as guide rollers swivelling about vertical axes. For the purpose of height adjustment the bedstead is provided with a lifting device which is arranged on a lower frame comprising the swivelling rollers and adapted to lift and lower an upper frame comprising a mattress support.

In the known sickbeds or nursing beds the swivelling rollers are held on the bedstead in that a holding element holding a roller body is fixed in a receiving portion of the bedstead. Each of these receiving portions is open only towards the lower side of the bedstead, i.e. in the direction of the floor. A bed having such a bedstead is described e.g. in U.S. Pat. No. 5,903,940.

Wear and damage to the roller bodies require the swivelling rollers to be exchanged. In the known beds this is a rather difficult and time-consuming process since the holding elements of the swivelling rollers can be removed from their receiving portions of the bedstead only in downward direction. This is troublesome since for this purpose the entire bed must be lifted to relieve the swivelling rollers of the load. Further if the bedstead is jacketed (for aesthetical reasons) in the area of its "roller feet", the jacketing must be removed in most cases, which adds to the expenditure and effort (in terms of time and assembly/disassembly).

From U.S. Pat. No. 5,737,801 a swivelling roller receiving device is known where a bearing block is unrotatably arranged in a U-shaped receiving element. In DE-C-43 195 16 the lower frame of a sickbed and/or nursing bed is described whose swivelling rollers can be centrally locked and released via an actuating rod assembly.

SUMMARY OF THE INVENTION

It is an object of the invention to provide a mobile bed whose swivelling rollers are easy to exchange.

This object is achieved with a bed, in particular a sickbed or nursing bed, provided with:

- a bedstead comprising a mattress supporting surface, and
- a plurality of swivelling rollers each of which comprises a holding element fastened to the bedstead and at least one roller body swivel-mounted on the holding element,
- wherein the bedstead comprises receiving portions for the holding elements, and
- wherein each receiving portion has an open lower side averting the mattress supporting surface of the bedstead, beyond which lower side the respective holding element projects.

According to the invention

- each receiving portion is also open on at least one side face extending essentially transversely to the lower side, and
- the holding elements are capable of being inserted via these side faces into the receiving portions.

According to the invention the swivelling rollers can, after releasing of a safety element, be removed in lateral direction from the bedstead. In this connection "in lateral direction" means removal of the swivelling rollers along a direction perpendicular to the normal line of the lower side of the bedstead.

According to the invention it is provided that each receiving portion is, besides its lower side, also open at a side face essentially extending transversely to the lower side. Thus the receiving portions are configured as edge recesses open at two faces extending essentially perpendicularly to each other. Into this receiving pockets the holding element plus the roller bodies can be inserted, wherein the holding element, when installed, projects in downward direction beyond the bedstead, and in this portion of the holding element the at least one roller body is held.

The configuration according to the invention does no longer require the bedstead and/or the entire bed to be lifted or turned over or similar measures to be taken for the purpose of exchanging the rollers. This considerably facilitates the exchange of the swivelling rollers. This is in particular important when the bedstead comprises completey encapsulated housing portions on which the rollers are arranged. Previously, such bedstead required the housing shells to be separated to exchange the rollers. This is no longer necessary with the present invention since the rollers merely need to be removed from the receiving portions formed by the two housing shells or to be inserted into these receiving portions.

Preferably, the holding elements of the swivelling rollers can be removed from the bedstead towards the longitudinal sides of the bed and/or inserted into the bedstead from the longitudinal sides of the bed. Alternatively, it is possible that the receiving portions are open towards the foot and/or head end of the bed.

That portion of a holding element which is received in a receiving portion is positively accommodated in this receiving portion. In other words, the form of the receiving portion or a receiving space is complementary to the form of the holding element portion received in the receiving space. This configuration is advantageous for reasons of stability.

For reasons of safety and comfort it is necessary that mobile beds can be locked. For this purpose the swivelling rollers comprise locking mechanisms provided with a locking element which presses against the tread of a roller body (frictional engagement) or positively blocks the roller body. The locking mechanisms of all swivelling rollers of a bed are preferably actuated via a central actuation mechanism. For this purpose the bedstead comprises a foot-operated actuating lever connected via an actuating rod assembly with the locking mechanisms of all swivelling rollers.

A coupling element of the locking mechanism of a swivelling roller is preferably arranged on the holding element of the swivelling roller and can be pushed onto a rod or a journal of the actuating rod assembly. The receiving portion according to the invention of the swivelling roller holding elements is advantageous since the capability of the holding element of being inserted into the receiving portion allows the coupling element of the locking mechanism of this swivelling roller to be simultaneously pushed onto a portion of the actuating rod assembly projecting into the receiving space.

BRIEF DESCRIPTION OF THE DRAWINGS

Hereunder the invention is described in detail with reference to the drawings in which.

DESCRIPTION OF THE PREFERRED EMBODIMENT

Figure 1:
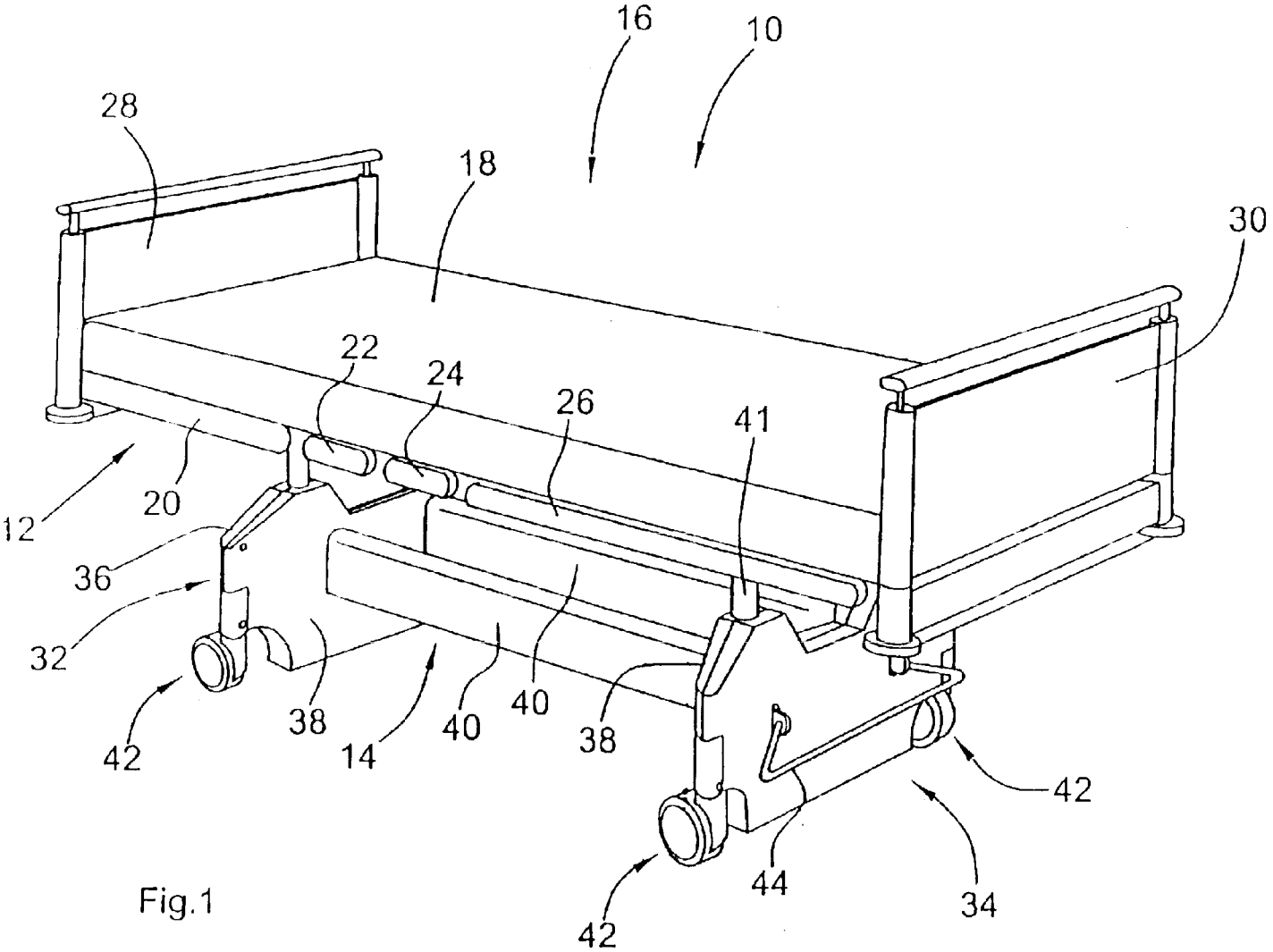
FIG. 1 shows a perspective view of a mobile sickbed or nursing bed.

FIG. 1 shows a perspective view of a sickbed or nursing bed 10 having a bedstead 12 being adjustable in height and comprising a lower frame 14 and an upper frame 16 with a mattress supporting surface comprising individual portions 20, 22, 24, and 26 which are movable relative to each other. Further, on the upper frame 16 a head end 28 and a foot end 30 are arranged.

The lower frame 14 is configured as a completey encapsulated housing and comprises a housing portion 32 at the head end and a housing portion 34 at the foot end, each portion being formed by two housing shells 36,38. Between the inner housing shells 38 facing each other two hollow supports 40 are arranged which are connected with the housing shells 38. By means of a lifting device 41 the upper frame 16 can be adjusted in height relative to the lower frame 14. The housing portions 32 and 34 are further provided with two swivelling rollers 42 each which are configured as guide rollers. All guide rollers 42 are provided with a locking mechanism which can be centrally activated and deactivated via a foot-operated actuating lever 44 to lock and/or release all guide rollers 42.

Figure 2:
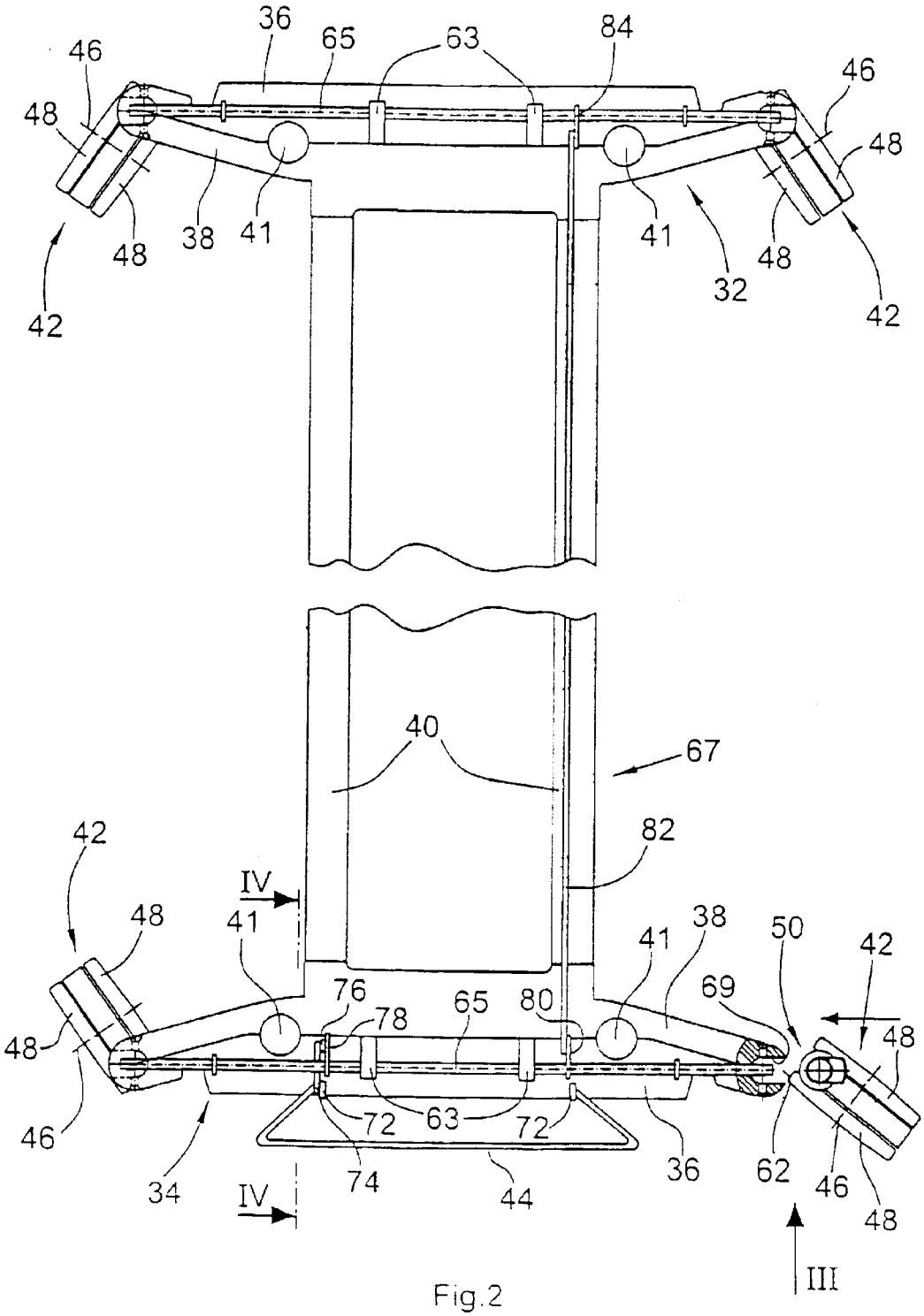
FIG. 2 shows a top view of the lower frame of the bed shown in FIG. 1 with the locking mechanism for blocking all swivelling rollers, wherein the cooperation of the holding elements of the swivelling rollers with the lower frame is shown.
Figure 3:
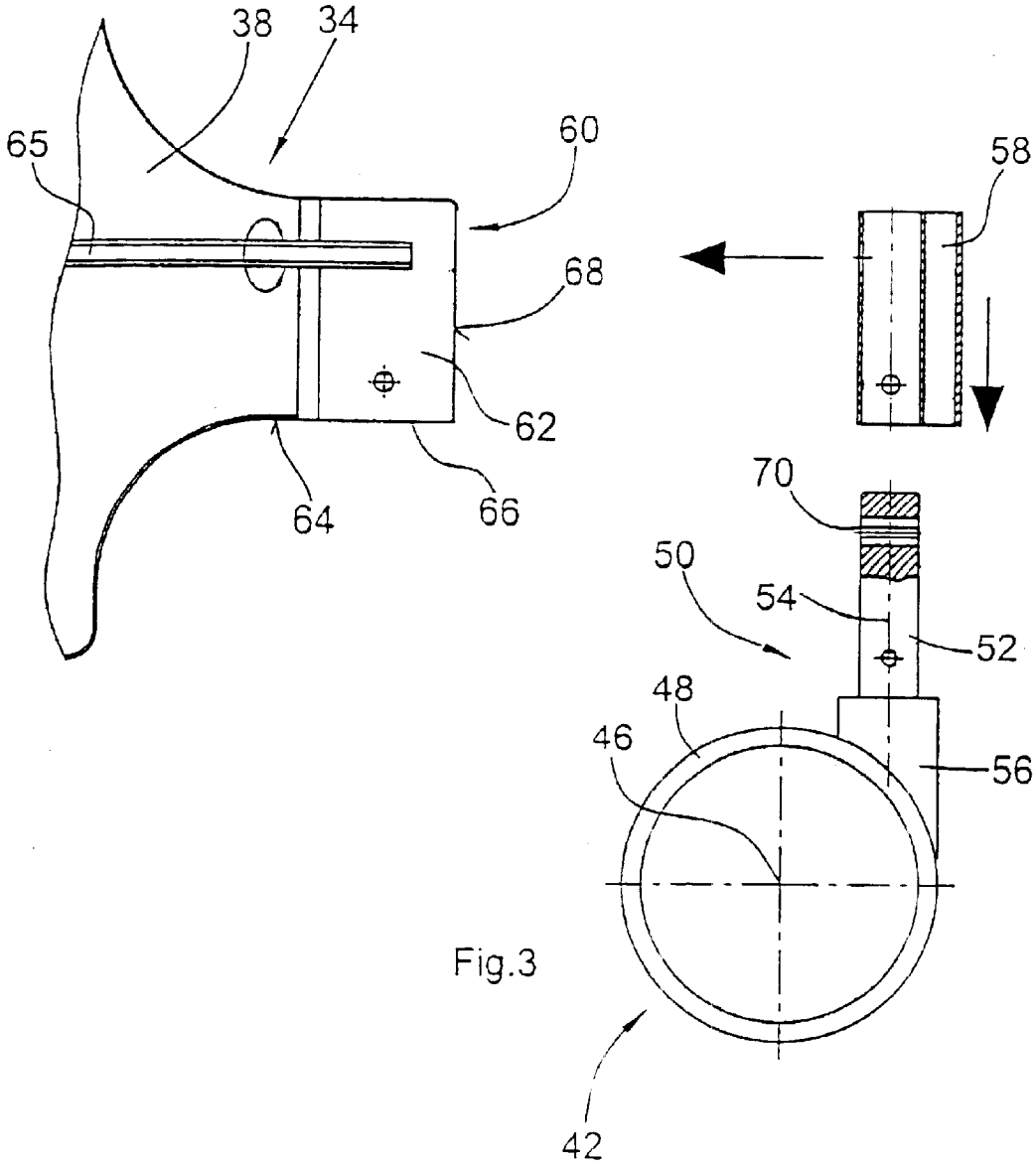
FIG. 3 shows a view in the direction of arrow III of FIG. 2.

As can be seen in FIGS. 2 and 3, each guide roller 42 comprises two roller bodies 48 arranged parallel to each other and rotatable about a common axis 46, which roller bodies 48 are held by a holding element 50. The holding element 50 comprises a bearing journal 52 which essentially extends parallel to an extension which is tangential relative to the roller bodies 48, and projects in upward direction beyond the roller bodies 48. The bearing journal 52 is fastened, rotatably about its longitudinal axis 54, at that portion (bearing arm. 56) of the holding element 50 on which the roller bodies 48 are rotatably supported.

As can be seen in particular in FIG. 3, an insertion part 58 is attached to the bearing journal 52, which insertion part 58, together with the bearing journal 52, is inserted in a receiving portion 60 of one of the housing portions 32,34. This receiving portion 60 is configured as a receiving space 62 which is open towards the lower side 64 of the respective housing portion 32,34 (shown at 66). Besides this opening 66, the receiving space 62 is also open towards a side face of the housing portion 32,34 which extends transversely to the opening 66. In FIGS. 2 and 3 this opening bears the reference numeral 68.

This configuration allows the guide roller 42 to be mounted in a simple manner to the housing portion 32,34 of the lower frame 14 of the bedstead 12 and/or to be removed from the housing portion 32,34 of the lower frame 14 of the bedstead 12. It is no longer necessary to lift the bed 10 since the lateral opening 68 of the respective receiving space 62 allows the insertion part 58 plus the bearing journal 52 to be inserted and removed in a direction parallel to the floor.

As can be seen in particular in FIG. 2, rods 65 of an actuating rod assembly 67 for the locking mechanisms of the guide rollers 42 extend into the receiving spaces 62. In each housing portion 32,34 such a rod 65 is rotatably supported via pivot bearings 63. These two rods 65 extend transversely to the longitudinal extension of the bed 10. At the sides 69 opposite the openings 68 the rods 65 extend into the receiving spaces 62, and are configured at least in this area, but preferably over their overall length, as a polygon profile. When the guide rollers 42 are mounted, the ends of the rods 65 are inserted into receiving bores 70 (see FIG. 3) of the bearing journals 52, where they are positively arranged. By rotating the rods 65 about their longitudinal axes, a brake element (not shown) is actuated in each bearing journal 52 of the guide rollers 42, which brake element is moved towards the roller bodies 48 to lock them and is moved away from the roller bodies 48 to release them.

Figure 4:
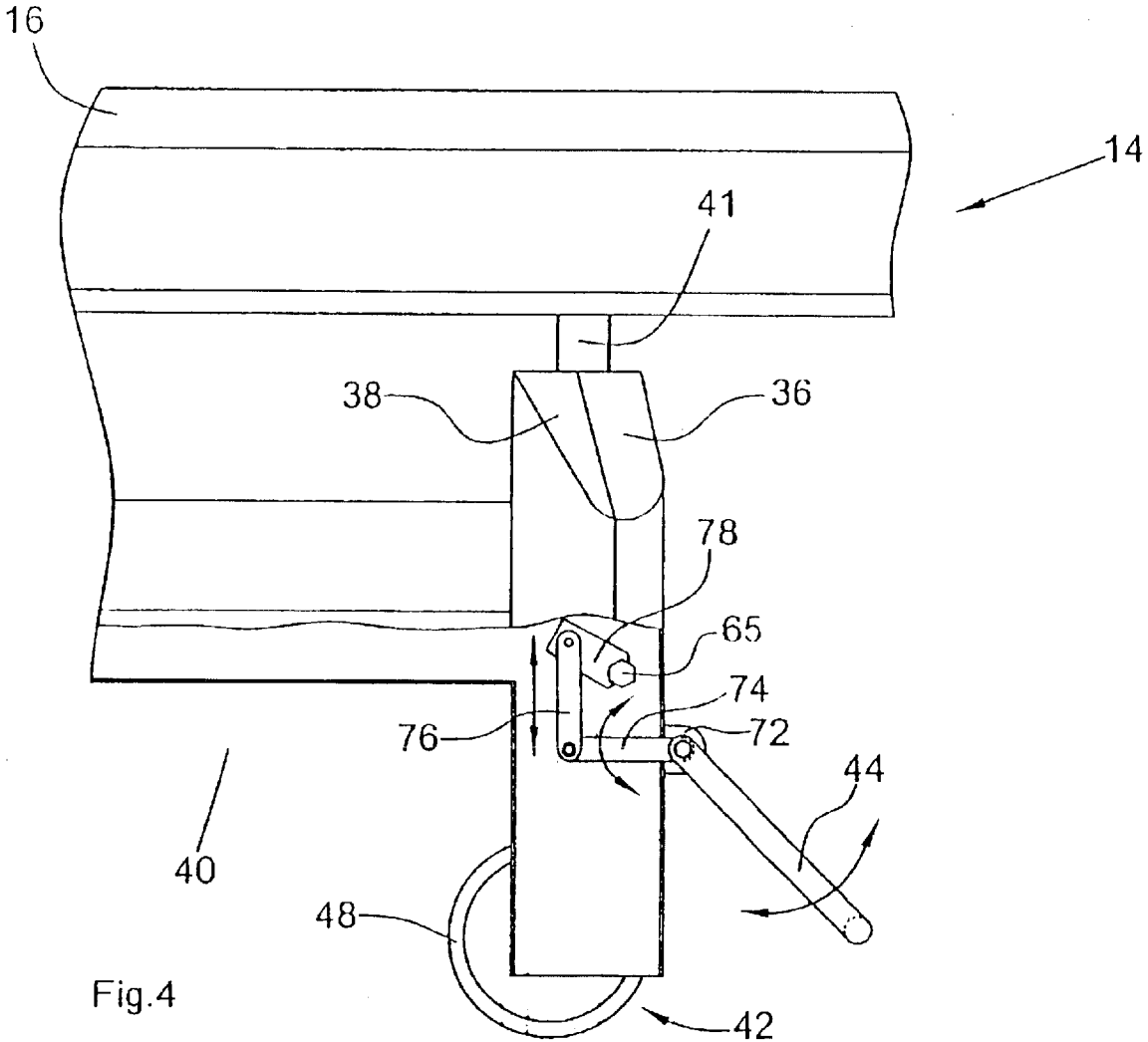
FIG. 4 shows a sectional view along line IV—IV of FIG. 2.

The simultaneous rotation of the two rods 65 of the actuating rod assembly 67 is effected with the aid of the foot-operated actuating lever 44. As can be seen in FIG. 4, this actuating lever 44 is, at 72, rotatably supported on the housing portion 34. Further, the actuating lever 44 is rigidly connected with levers 74 at its ends which are rotatably supported at 72, which levers 74 are pivoted together with the actuating lever 44. The pivoting motion of these levers 74 is transmitted via further levers 76 and 78, which are rotatably connected with the levers 74, to the rod 65. The levers 78 are rigidly connected with the rod 65 and articulated to the levers 76 which, on their part, are articulated to the levers 74. In this manner the rod 65 can be rotated in the housing portion 34 by pivoting the actuating lever 44.

The rotating motion of this rod 65 is transmitted via another lever 80, which is rigidly connected with the rod 65, to a transmission rod 82 which extends through one of the two hollow supports 40 into the other housing portion 32. There, the linear motion of the transmission rod 82 is converted into a rotating motion of the rod 65 with which the brake mechanisms of the guide rollers 42 are coupled. A lever 84 connecting the transmission rod 82 with the rod 65 is provided for this purpose.

Although a preferred embodiment of the invention has been specifically illustrated and described herein, it is to be understood that minor variations may be made without departing from the spirit and scope of the invention, as defined in the appended claims.

What is claimed is:

1. A bed, comprising:

a bedstead with a mattress supporting surface; and a plurality of swivelling rollers each of which comprises a holding element fastened to the bedstead and at least one roller body swivel-mounted on the holding element, wherein the bedstead comprises receiving portions for the holding elements, wherein each receiving portion has an open lower side averting the mattress supporting surface of the bedstead, beyond which lower side the respective holding element projects, wherein each receiving portion is also open on at least one side face extending essentially transversely to the lower side, wherein the holding elements are capable of being inserted via these side faces into the receiving portions, and wherein each holding element comprises at least one bearing arm on which the respective at least one roller body is supported, and a bearing journal connected with the at least one bearing arm, the bearing journal being received in a receiving portion and capable of being fastened to the bedstead.

2. The bed according to claim 1, wherein a pair of swivelling rollers is arranged at both the head end and the foot end of the bedstead, and for each pair of swivelling rollers the open side faces of the receiving portions for the holding elements of the swivelling rollers avert each other and face the longitudinal sides of the bedstead.

3. The bed according to claim 1, wherein the receiving portions are configured as receiving spaces being closed with the exception of their lower sides and one of the side faces, and the form of the receiving spaces is essentially complementary to that of the portions of the holding elements received by the receiving spaces.

4. The bed according to claim 1, wherein at least one of the holding elements comprises a bearing journal which is rotatable about a rotating axis extending transversely to the rotating axis of the at least one roller body connected with the at least one bearing arm of the holding element.

5. A bed, comprising:

a bedstead with a mattress supporting surface; and a plurality of swivelling rollers each of which comprises a holding element fastened to the bedstead and at least one roller body swivel-mounted on the holding element, wherein the bedstead comprises receiving portions for the holding elements, wherein each receiving portion has an open lower side averting the mattress supporting surface of the bedstead, beyond which lower side the respective holding element projects, wherein each receiving portion is also open on at least one side face extending essentially transversely to the lower side, wherein the holding elements are capable of being inserted via these side faces into the receiving portions, and wherein at least some of the holding elements comprise a locking mechanism having a movable locking element for locking the at least one roller body, wherein the locking mechanism is capable of being coupled, in particular releasably coupled, on that side of the holding element which is opposite the at least one open side face of the receiving portion of the bedstead receiving the holding element, with an actuating rod assemby for actuating the locking mechanism.

6. The bed according to claim 5, wherein for one of two pairs of holding elements arranged on the head end and on the foot end of the bedstead a common actuating lever is provided which is connected with the actuating rod assembly in the area between the two holding elements and between the two receiving portions.

7. The bed according to claims 6, wherein the actuating rod assembly coupled with the actuating lever is also capable of being coupled, in particular releasably coupled, to the locking mechanisms of the two holding elements of the other pair of swivelling rollers.

* * * * *